US006751981B1

(12) United States Patent
Burnette

(10) Patent No.: US 6,751,981 B1
(45) Date of Patent: Jun. 22, 2004

(54) INSULATION BOX KIT AND METHOD OF USING

(76) Inventor: Alan E. Burnette, 21806 Hildebrandt, Brownstown, MI (US) 48134

( * ) Notice: Subject to any disclaimer, the term of this patent is extended or adjusted under 35 U.S.C. 154(b) by 0 days.

(21) Appl. No.: 10/342,461

(22) Filed: Jan. 14, 2003

(51) Int. Cl.[7] ..... F25D 3/08; A47J 39/00
(52) U.S. Cl. ..... 62/457.2; 62/371; 220/592.19
(58) Field of Search ..... 62/457.2, 457.1, 62/371, 372; 206/446; 220/592.19, 592.25, 592.18, 592.17, 4.21, 4.22, 4.24

(56) References Cited

U.S. PATENT DOCUMENTS 4,633,678 A * 1/1987 Lea et al. ..... 62/457.1
4,976,355 A * 12/1990 Crutchfield ..... 206/457
5,564,568 A * 10/1996 Rankin, Sr. ..... 206/446
6,269,826 B1 * 8/2001 Zheng ..... 135/126

* cited by examiner

*Primary Examiner*—Chen Wen Jiang

(57) ABSTRACT

An insulation box kit and associated method of using are disclosed for use in assembling the kit into a storage chamber for use in cooling a beer keg stored within the confines of the chamber. The kit comprising: a base element, four side walls, and a top element. Each side wall includes a means for attaching onto said base element and a means for interconnecting to adjacent side walls. The top element includes a centrally disposed collar defining a centrally disposed hole; and a means for connecting onto said four side walls to said top element. The method of using comprises the steps of adjoining, affixing, closing, getting, interlinking, locating, mounting, obtaining, opening, placing, pouring, pumping, putting, retrieving, sliding, slipping, and sitting.

2 Claims, 3 Drawing Sheets

INSULATION BOX KIT AND METHOD OF USING

FIELD OF INVENTION

The present invention relates in general to apparatus for use with keg beer. In particular, the present invention relates to an insulation box kit for use in assembling the kit into a storage chamber for use in cooling a beer keg stored within the confines of the chamber.

DESCRIPTION OF PRIOR ART

The dispensing of beer or other beverages from kegs is well known. Keg beer provides an economical method of packaging beer. However, various problems have been associated with this practice.

First, it is typically preferred that the beer remain in a chilled condition, or at least not reach an elevated temperature, at all times for best flavor. However, beer distributors typically do not employ refrigerated trucks to transport the kegs from the central distribution point to the various retail outlets. In warm weather this can result in the beer reaching an elevated temperature and losing the desired flavor. Similarly, in cold weather this poses a risk of causing freezing of the beer, damaging it flavor and possibly damaging the keg itself.

Second, the use of kegs has been especially troublesome for the end user. Full kegs are typically quite heavy, and are difficult to carry manually. Additionally, keeping the tapped keg cool has not been a simple task. It is common for the keg to be placed in a large receptacle (often a trash can) and surrounded with ice. The ice will often melt significantly prior to the keg being emptied, creating water. As the keg is emptied it becomes lighter, and will often float in this water before it is fully emptied. This creates problems in pumping the keg to maintain internal pressure. Additionally, if the receptacle leaks, the water will escape. This is especially troublesome at outdoor events, as it commonly forms mud in the high-traffic area surrounding the keg.

A wide variety of beer keg cooler devices is currently available on the commercial market and an even larger number of these types of devices are known in the art of beer keg cooler devices, for example, the container for a keg or the like disclosed by Hunt in U.S. Pat. No. 3,232,491; the ice box for beer barrel disclosed by Yanes in U.S. Pat. No. 3,789,622; the beer keg cooling container disclosed by Ruano in U.S. Pat. No. 4,042,142; the keg cooler disclosed by Lea and Lea in U.S. Pat. No. 4,633,678; the insulating cover for keg beer disclosed by Rankin, Sr. in U.S. Pat. No. 5,564,568; and the beer keg cooler disclosed by Trkla and Throolin in U.S. Pat. No. D269,148

While all of the above-described devices fulfill their respective, particular objectives and requirements, the aforementioned patents do not describe an insulation box kit having a base element, four side walls, and a top element, in which each side wall includes a means for attaching onto said base element and a means for interconnecting to adjacent side walls, and wherein the top element includes a centrally disposed collar defining a centrally disposed hole; and a means for connecting onto said four side walls to said top element. This combination of elements would specifically match the user's particular individual needs of making it possible to to use the kit to rapidly assemble a storage chamber for use in cooling a beer keg stored within the confines of the chamber. The above-described patents make no provision for an insulation box kit having a base element, four side walls, and a top element, in which each side wall includes a means for attaching onto said base element and a means for interconnecting to adjacent side walls, and wherein the top element includes a centrally disposed collar defining a centrally disposed hole; and a means for connecting onto said four side walls to said top element.

Therefore, a need exists for a new and improved insulation box kit having a base element, four side walls, and a top element, in which each side wall includes a means for attaching onto said base element and a means for interconnecting to adjacent side walls, and wherein the top element includes a centrally disposed collar defining a centrally disposed hole; and a means for connecting onto said four side walls to said top element. In this respect, the insulation box kit according to the present invention substantially departs from the conventional concepts and designs of the prior art, and in doing so provides an apparatus primarily developed for the purpose of providing a means for rapidly assembling a storage chamber for use in cooling a beer keg stored within the confines of the chamber.

SUMMARY OF THE INVENTION

The present kit and method of using, according to the principles of the present invention, overcomes the shortcomings of the prior art by providing a insulation box kit and method of using is disclosed. The kit comprising: a base element, four side walls, and a top element. Each side wall includes a means for attaching onto said base element and a means for interconnecting to adjacent side walls. The top element includes a centrally disposed collar defining a centrally disposed hole; and a means for connecting onto said four side walls to said top element. The method of using comprises the steps of adjoining, affixing, closing, getting, interlinking, locating, mounting, obtaining, opening, placing, pouring, pumping, putting, retrieving, sliding, slipping, and sitting. in which the device comprises In view of the foregoing disadvantages inherent in the known type beer keg cooler devices now present in the prior art, the present invention provides an improved insulation box kit, which will be described subsequently in great detail, is to provide a new and improved insulation box kit which is not anticipated, rendered obvious, suggested, or even implied by the prior art, either alone or in any combination thereof.

To attain this, the present invention essentially comprises a base element, four side walls, and a top element. Each side wall includes a means for attaching onto said base element and a means for interconnecting to adjacent side walls. The top element includes a centrally disposed collar defining a centrally disposed hole; and a means for connecting onto said four side walls to said top element.

There has thus been outlined, rather broadly, the more important features of the invention in order that the detailed description thereof that follows may be better understood, and in order that the present contribution of the art may be better appreciated.

The invention may also include a beer keg. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved insulation box kit that has all the advantages of the prior art insulation box kit and none of the disadvantages.

It is another object of the present invention to provide a new and improved insulation box kit that may be easily and efficiently manufactured and marketed.

An even further object of the present invention is to provide a new and improved insulation box kit that has a low cost of manufacture with regard to both materials and labor, and which accordingly is then susceptible of low prices of sale to the consuming public, thereby making such multipurpose storage unit and system economically available to the buying public.

Still another object of the present invention is to provide a new insulation box kit that provides in the apparatuses and methods of the prior art some of the advantages thererof, while simultaneously overcoming some of the disadvantages normally associated therewith.

Even still another object of the present invention is to provide a insulation box kit having a base element, four side walls, and a top element, in which each side wall includes a means for attaching onto said base element and a means for interconnecting to adjacent side walls, and wherein the top element includes a centrally disposed collar defining a centrally disposed hole; and a means for connecting onto said four side walls to said top element. This combination of elements makes it possible to use the kit to rapidly assemble a storage chamber for use in cooling a beer keg stored within the confines of the chamber.

Lastly, it is an object of the present invention to provide a new and improved method of using comprising the steps of adjoining, affixing, closing, getting, interlinking, locating, mounting, obtaining, opening, placing, pouring, pumping, putting, retrieving, sliding, slipping, and sitting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
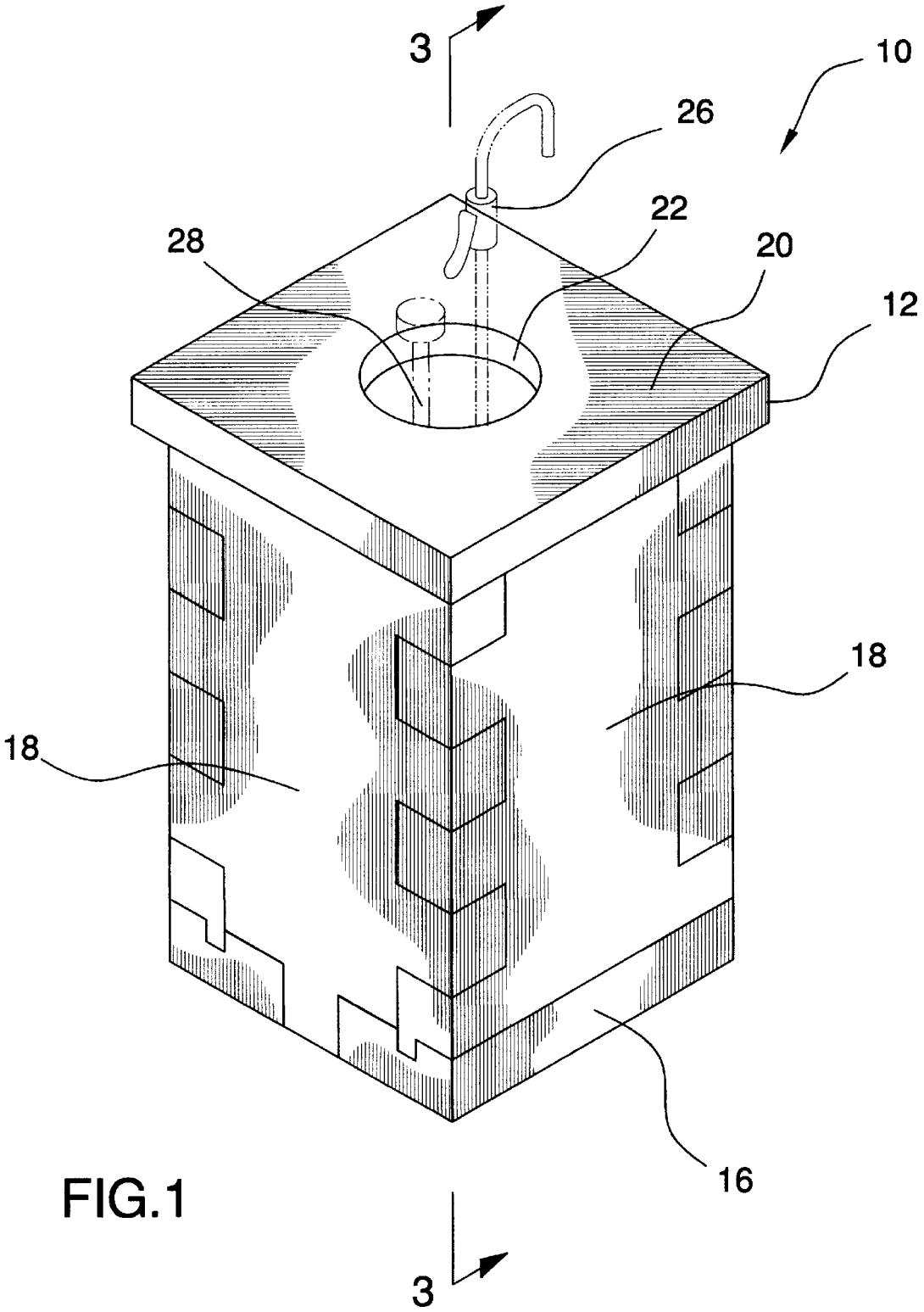
FIG. 1 is a perspective view of an assembled preferred embodiment of the insulation box kit constructed in accordance with the principles of the present invention.
Figure 2:
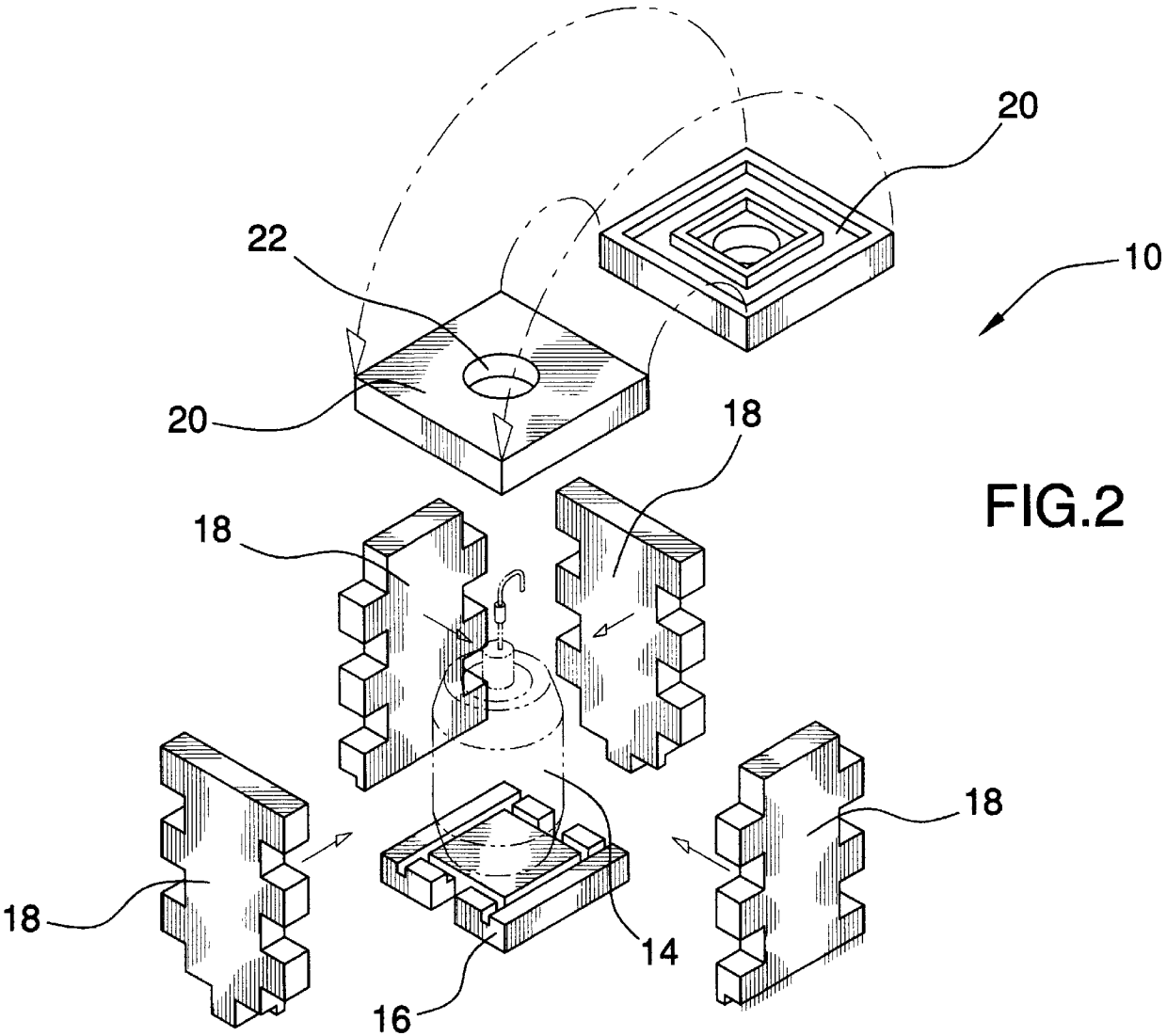
FIG. 2 is a view of a preferred embodiment of an unassembled insulation box kit of the present invention.
Figure 3:
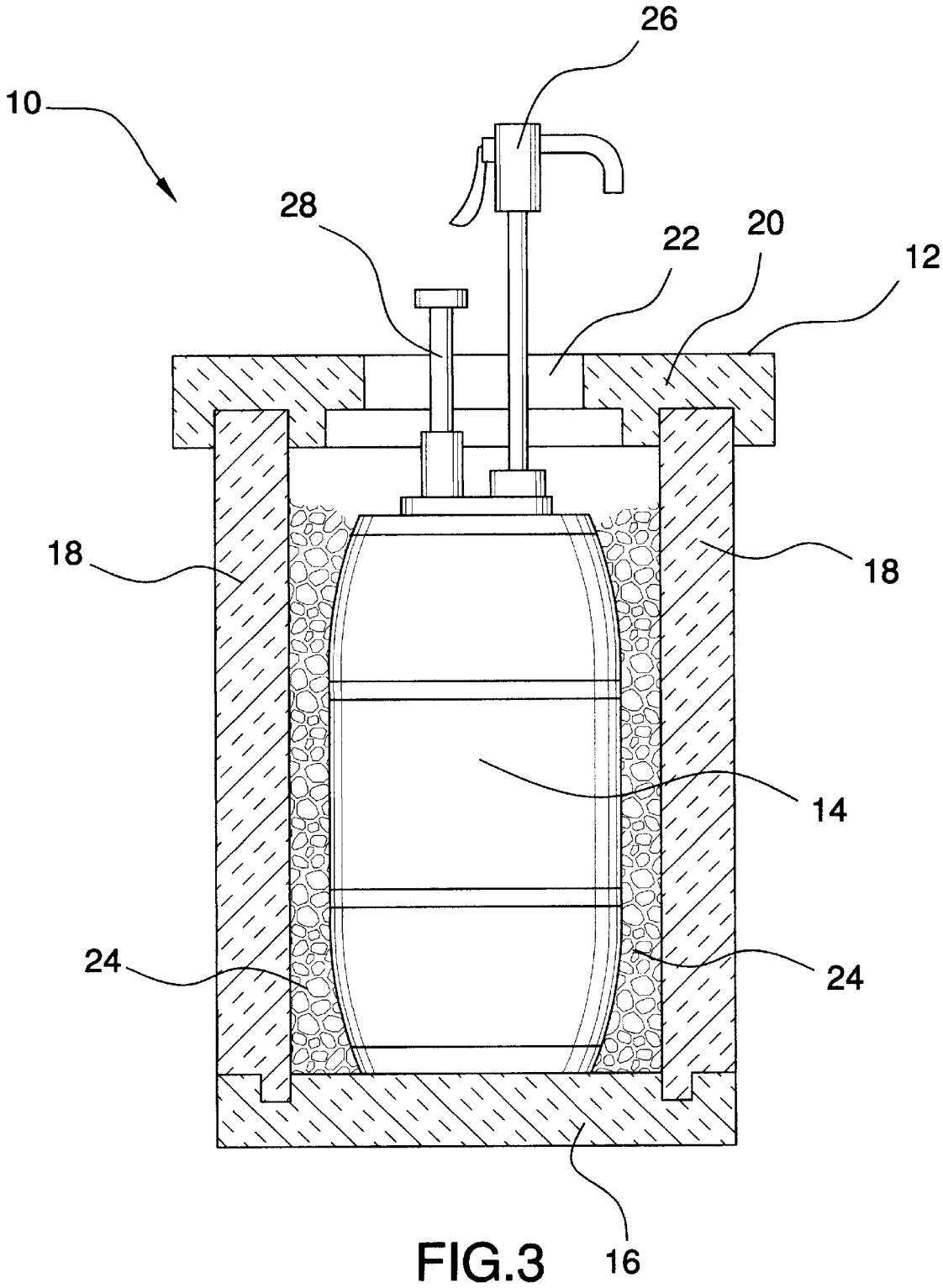
FIG. 3 is a cross sectional side view of an assembled preferred embodiment of the insulation box kit of the present invention.

Referring now to the drawings, and in particular FIG. 1 to 3 thereof, one preferred embodiment of the present invention is shown and generally designated by the reference numeral 10. One preferred embodiment of an insulation box kit 10 for assembling a storage chamber 12 for use in cooling a beer keg 14 stored within the confines of the chamber 12, said kit 10 comprising: a base element 16, four side walls 18, and a top element 20. Each side wall 18 includes a means for attaching onto said base element 16 and a means for interconnecting to adjacent side walls 18. The top element 20 includes a centrally disposed collar defining a centrally disposed hole 22; and a means for connecting onto said four side walls 18 to said top element 20.

Another preferred embodiment of the kit consist essentially of a base element 16, four side walls 18, and a top element 20. Each side wall 18 includes a means for attaching onto said base element 16 and a means for interconnecting to adjacent side walls 18. The top element 20 includes a centrally disposed collar defining a centrally disposed hole 22; and a means for connecting onto said four side walls 18 to said top element 20.

An optional beer keg 14 may be added to the kit 10.

An optional aliquot of ice 24 may be added to the kit 10.

The base element 16 may be made of any commercially available material. One preferred configuration of the base element 16 is that the base element 16 comprises a polymeric material. The polymeric material may be selected form the group consisting of ethylene, propylene, butene-1, isobutene, vinyl chloride, vinylidene chloride, ethyl acrylate, methyl methacrylate, styrene, .alpha.-methylstyrene, ar-(t-butyl) styrene, ethyl cellulose, methyl cellulose, ethylene/vinyl acetate copolymer, ethylene/acrylic acid copolymer, ethylene/methyl methacrylate acid copolymer, ionomer salt of such acid copolymers, and blends thereof. The polymeric material may also be selected form the group consisting of nylon, polyester, polypropylene, polyurethanes, polyacryls, polymethacryls, cellulosic polymers, styrene-acryl copolymers, polystyrene-polyacryl mixtures, polysiloxanes, polyesters, urethane-acryl copolymers, siloxane-urethane copolymers, polyurethane-polymethacryl mixtures, silicone-acryl copolymers, vinyl acetate polymers, and mixtures thereof. Another preferred configuration of the base element 16 is that the base element 16 comprises a wood material selected from the group consisting ash, aspen, oak, pine, fir, walnut, elm, and cedar.

The top element 20 may be made of any commercially available material. One preferred configuration of the top element 20 is that the top element 20 comprises a polymeric material. The polymeric material may be selected form the group consisting of ethylene, propylene, butene-1, isobutene, vinyl chloride, vinylidene chloride, ethyl acrylate, methyl methacrylate, styrene, .alpha.-methylstyrene, ar-(t-butyl) styrene, ethyl cellulose, methyl cellulose, ethylene/vinyl acetate copolymer, ethylene/acrylic acid copolymer, ethylene/methyl methacrylate acid copolymer, ionomer salt of such acid copolymers, and blends thereof. The polymeric material may also be selected form the group consisting of nylon, polyester, polypropylene, polyurethanes, polyacryls, polymethacryls, cellulosic polymers, styrene-acryl copolymers, polystyrene-polyacryl mixtures, polysiloxanes, polyesters, urethane-acryl copolymers, siloxaneurethane copolymers, polyurethane-polymethacryl mixtures, silicone-acryl copolymers, vinyl acetate polymers, and mixtures thereof. Another preferred configuration of the top element 20 is that the top element 20 comprises a wood material selected from the group consisting ash, aspen, oak, pine, fir, walnut, elm, and cedar.

Each side wall 18 may be made of any commercially available material. One preferred configuration of each side wall 18 is that each side wall 18 comprises a polymeric material. The polymeric material may be selected form the group consisting of ethylene, propylene, butene-1, isobutene, vinyl chloride, vinylidene chloride, ethyl acrylate, methyl methacrylate, styrene, alpha-methylstyrene, ar-(t-butyl) styrene, ethyl cellulose, methyl cellulose, ethylene/vinyl acetate copolymer, ethylene/acrylic acid copolymer, ethylene/methyl methacrylate acid copolymer, ionomer salt of such acid copolymers, and blends thereof. The polymeric material may also be selected form the group consisting of nylon, polyester, polypropylene, polyurethanes, polyacryls, polymethacryls, cellulosic polymers, styrene-acryl copolymers, polystyrene-polyacryl mixtures, polysiloxanes, polyesters, urethane-acryl copolymers, siloxaneurethane copolymers, polyurethane-polymethacryl mixtures, silicone-acryl copolymers, vinyl acetate polymers, and mixtures thereof. Another preferred configuration of each side wall 18 is that each side wall 18 comprises a wood material selected from the group consisting ash, aspen, oak, pine, fir, walnut, elm, and cedar.

One preferred embodiment of a method of using an insulation box kit 10 for assembling a storage chamber 12 for use in cooling a beer keg 14 stored within the confines of the chamber 12, said method comprising the steps of adjoining, affixing, closing, getting, interlinking, locating, mounting, obtaining, opening, placing, pouring, pumping, putting, retrieving, sliding, slipping, and sitting. The obtaining step comprises obtaining the kit 10 comprising: a base element 16; four side walls 18, each side wall 18 including: a means for attaching onto the base element 16 and a means for interconnecting to adjacent side walls 18; and a top element 20 including a centrally disposed collar defining a centrally disposed hole 22; and a means for connecting onto the four side walls 18 to the top element 20. The getting step comprises getting the beer keg 14. The putting step comprises putting on a spigot 26 onto the beer keg 14. The mounting step comprises mounting a hand pump 28 onto the beer keg 14. The placing step comprises placing the base element 16 of the kit 10 onto a stable flat surface. The sitting step comprises sitting the beer keg 14 onto the center of the base element 16 of the kit 10 placed on the stable flat surface. The interlinking step comprises interlinking the four side walls 18 together. The adjoining step comprises adjoining together the interlinked four side walls 18 to the base element 16, said adjoining step performed subsequent to said getting, placing, sitting and interlinking steps, wherein the interlinked four side walls 18 adjoined to base element 16 defining the chamber 12 sequestering a portion of the beer keg 14 sitting on the base element 16. The locating step comprises locating an aliquot of ice 24. The pouring step comprises pouring a portion of the ice 24 into the chamber 12 defined by the interlinked four side walls 18 adjoined to the base element 16 so that a part of the beer keg 14 is surrounded by ice 24. The slipping step comprises slipping a portion of the spigot 26 through the hole 22 of the top element 20, said slipping step performed subsequent to said putting, sitting and pouring steps. The sliding step comprises sliding a portion of the hand pump 28 through the hole 22 of the top element 20, said sliding step performed subsequent to said putting, sitting, pouring and slipping steps. The affixing step comprises affixing together the top element 20 onto the four side walls 18, wherein said affixing step performed subsequent to said adjoining, putting, sitting, slipping, and sliding steps. The pumping step comprises pumping on the hand pump 28 mounted onto the beer keg 14 to raise the beer keg 14's internal pressure. The opening step comprises opening the spigot 26 put onto the beer keg 14, said opening step performed subsequent to said pumping step. The retrieving step comprises retrieving an aliquot of beer into a cup from the opened spigot 26 put onto the beer keg 14, said retrieving step performed while the spigot 26 is opened. The closing step comprises closing the spigot 26 put onto the beer keg 14, said closing step performed subsequent to said retrieving step.

Referring now to FIG. 1, which depicts a perspective view of an assembled preferred embodiment of the insulation box kit 10 showing a base element 16, side walls 18, and a top element 20. The top element 20 is shown having a centrally disposed collar defining a centrally disposed hole 22 so that the spigot 26 and hand pump 28 are accessible while sequestering the beer keg within the confines of the chamber 12.

Referring now to FIG. 2, which depicts a view of a preferred embodiment of an unassembled insulation box kit 10 showing a base element 16, four side walls 18, and a top element 20. Each side wall 18 is shown having a means for attaching onto said base element 16 and a means for interconnecting to adjacent side walls 18. The top element 20 is shown having a centrally disposed collar defining a centrally disposed hole 22; and a means for connecting onto said four side walls 18 to said top element 20.

Referring now to FIG. 3, which depicts a cross sectional side view of an assembled preferred embodiment of the insulation box kit 10 showing a base element 16 connected to side walls 18, and a top element 20 connected to side walls 18. The top element 20 is shown having a centrally disposed collar defining a centrally disposed hole 22 so that the spigot 26 and hand pump 28 are accessible while sequestering the beer keg within the confines of the chamber 12 so that ice 24 may be used to cool the beer keg 14.

As to the manner of usage and operation of the present invention, the same should be apparent from the above description. Accordingly, no further discussion relating to the manner of usage and operation will be provided.

While a preferred embodiment of the insulation box kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulation box kit for assembling a storage chamber for use in cooling a beer keg stored within the confines of the chamber, said kit comprising:

a base element;

four side walls, each side wall including:

a means for attaching onto said base element and a means for interconnecting to adjacent side walls; and a top element including:

a centrally disposed collar defining a centrally disposed pole;

a means for connecting onto said four side walls to said top element; and a beer keg.

2. A method of using an insulation box kit for assembling a storage chamber for use in cooling a beer keg stored within the confines of the chamber, said method comprising the steps of:

obtaining the kit comprising:

a base element;

four side walls, each side wall including:

a means for attaching onto the base element and a means for interconnecting to adjacent side walls; and a top element including a centrally disposed collar defining a centrally disposed hole; and a means for connecting onto the four side walls to the top element;

getting the beer keg;

putting on a spigot onto the beer keg;

mounting a hand pump onto the beer keg;

placing the base element of the kit onto a stable flat surface;

sitting the beer keg onto the center of the base element of the kit placed on the stable flat surface;

interlinking the four side walls together;

adjoining together the interlinked four side walls to the base element, said adjoining step performed subsequent to said getting, placing, sitting and interlinking steps, wherein the interlinked four side walls adjoined to base element defining the chamber sequestering a portion of the beer keg sitting on the base element;

locating an aliquot of ice;

pouring a portion of the ice into the chamber defined by the interlinked four side walls adjoined to the base element so that a part of the beer keg is surrounded by ice;

slipping a portion of the spigot through the hole of the top element, said slipping step performed subsequent to said putting, sitting and pouring steps;

sliding a portion of the hand pump through the hole of the top element, said sliding step performed subsequent to said putting, sitting, pouring and slipping steps; affixing together the top element onto the four side walls, wherein said affixing step performed subsequent to said adjoining, putting, sitting, slipping, and sliding steps;

pumping on the hand pump mounted onto the beer keg to raise the beer keg's internal pressure;

opening the spigot put onto the beer keg, said opening step performed subsequent to said pumping step;

retrieving an aliquot of beer into a cup from the opened spigot put onto the beer keg, said retrieving step performed while the spigot is opened; and closing the spigot put onto the beer keg, said closing step performed subsequent to said retrieving step.

* * * * *